United States Patent [19]

Nasu et al.

[11] 4,363,169

[45] Dec. 14, 1982

[54] ELECTRIC SHAVER

[75] Inventors: Sataro Nasu, Hikone; Hikoyoshi Hara, Shijonawate; Kouichi Iwanaga, Hikone, all of Japan

[73] Assignee: Matsushita Electric Works, Ltd., Osaka, Japan

[21] Appl. No.: 240,074

[22] Filed: Mar. 3, 1981

[30] Foreign Application Priority Data

Mar. 3, 1980 [JP] Japan ..... 55-26857

[51] Int. Cl.[3] ..... B26B 19/38

[52] U.S. Cl. ..... 30/41; 30/41.5

[58] Field of Search ..... 30/41, 41.5

[56] References Cited

U.S. PATENT DOCUMENTS

| | | | |
|---|---|---|---|
| 3,079,684 | 3/1963 | Hertzberg | 30/41 X |
| 3,103,299 | 9/1963 | Werft | 30/41 X |
| 3,299,506 | 1/1967 | Gwinn | 30/41 |
| 3,359,634 | 12/1967 | Beck | 30/41 |

*Primary Examiner*—Jimmy C. Peters

*Attorney, Agent, or Firm*—Burns, Doane, Swecker & Mathis

[57] ABSTRACT

Electric shaver of battery powered and washable type having a watertight housing structure. A battery covering detachably mounted to housing bottom opening for holding batteries inside the housing includes a lock and seal which are activated, responsive to the covering's mounting operation, respectively in directions transversing the housing axis to lock the covering to the housing interior wall and in the housing axial directions to achieve uniform abuttment of the covering to the interior wall for clamping therebetween a watertight ring seal. At the housing head where shaving blade assembly is coupled to rotary shaft of electric motor, the shaft is projected out of an axial cylinder of motor mounting member through a double-lip shape bushing watertightly sealing around the shaft with both axial end and outer peripheral projections compressively deformed by inward flange and inner periphery of the axial cylinder and motor shaft bearing so as to maintain a proper sealing pressure about the shaft, while allowing water passed through cut-hair reservoir between the motor and the blade assembly with side wall apertures of the reservoir closable by a shutter ring slidably fitted therearound, and in a housing side wall a reed-switch inside the housing is controlled over the side wall by a magnet carried by a handle slidably fitted outside the wall.

13 Claims, 34 Drawing Figures

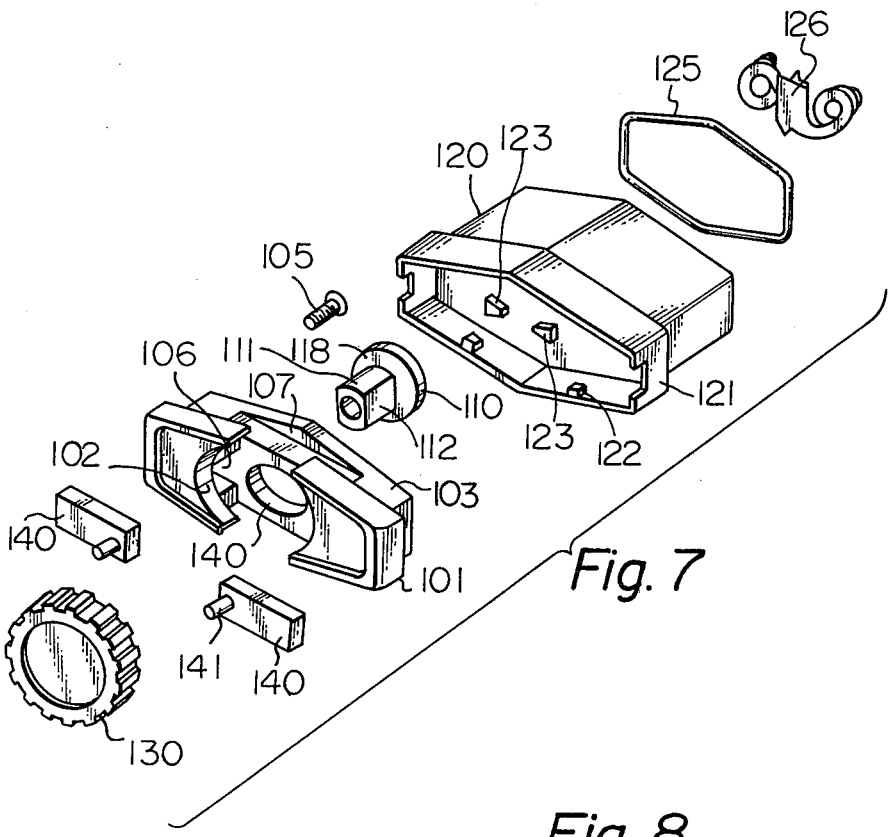
Fig. 7
Fig. 8
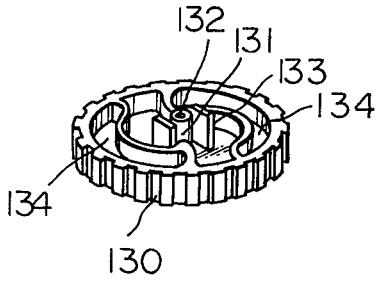
Fig. 9
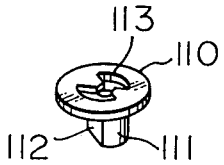

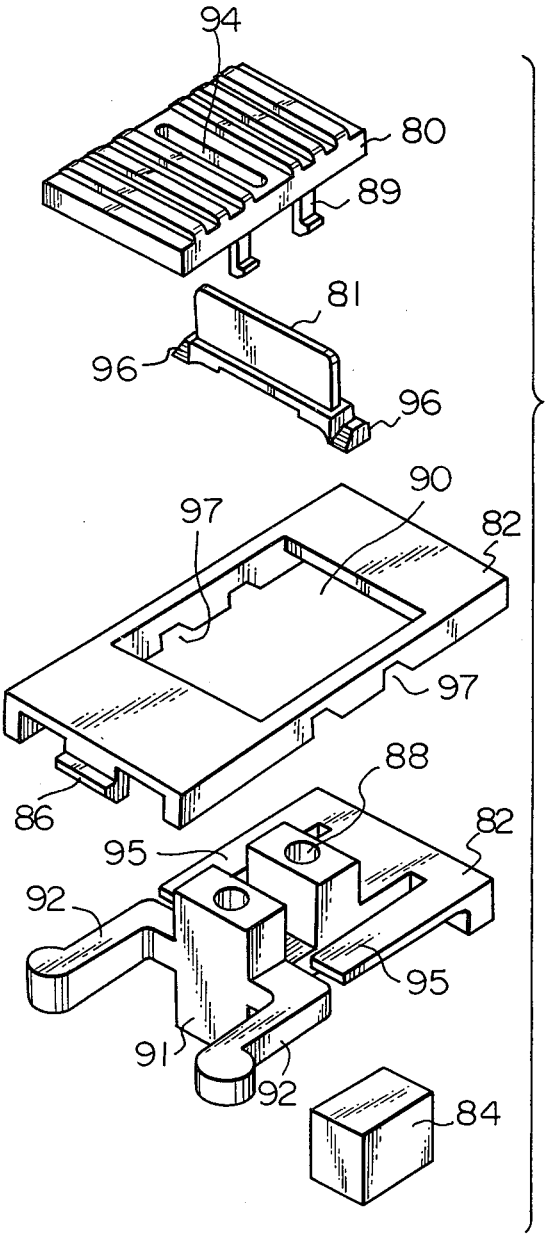
Fig. 16
Fig. 17
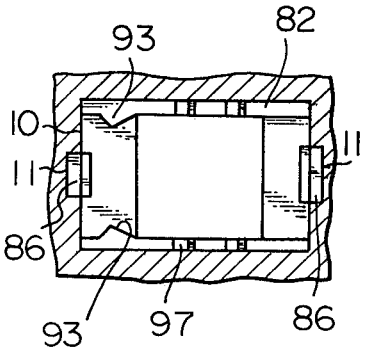

Fig. 19A
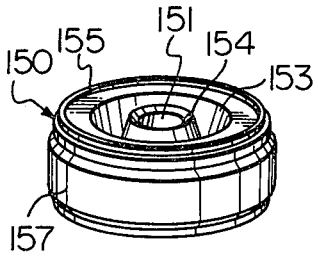
Fig. 19C
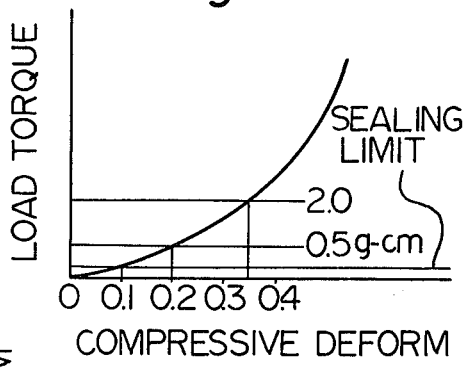
Fig. 19B
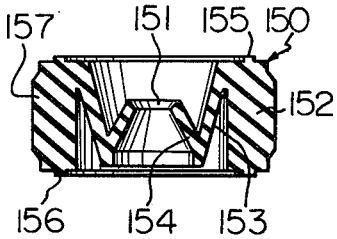
Fig. 19D
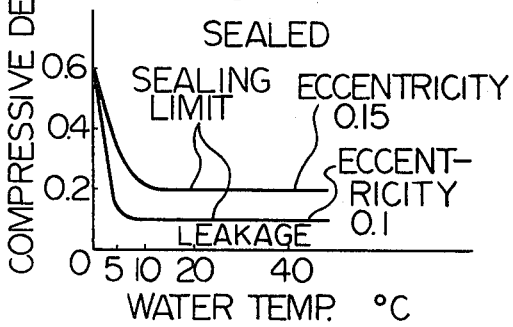
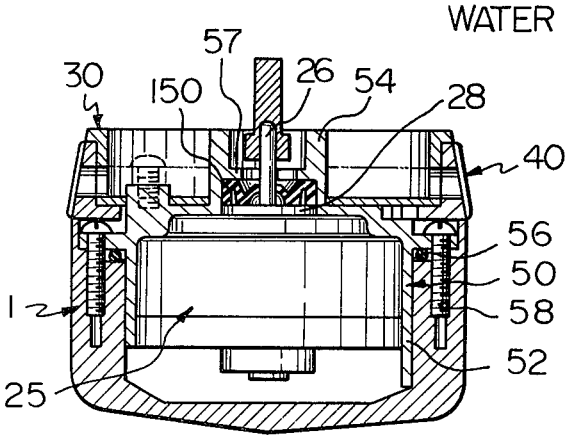
Fig. 20

ELECTRIC SHAVER

This invention relates generally to electric shavers and, more particularly, to watertight housing structure for the shavers of battery powered and washable type.

In achieving the watertight structure of the shaver housing for rendering specifically shaving head and its interior cut-hair reservoir to be washable, it is necessary to establish sufficient watertight sealings in the shaver at the head part of the housing where an electric motor is housed inside and a shaving blade assembly is mounted outside as operably coupled to rotary shaft of the motor, at the bottom opening of the housing through which a battery or batteries are inserted in the housing and held in position by a battery covering fitted to the opening, and at a mounting portion of switch block for ON and OFF controlling of power supply circuit to the motor. The required sealing at the head part involves normally the one between respective engaging edges of an opening of the housing head and a motor mounting member fitted to the head opening and the other at an aperture of the motor mounting member for projecting the rotary shaft of the motor thereout, but the former sealing part is rather easily obtainable since the motor can be maintained generally permanently as fixed by means of screws or the like, while the latter must take into consideration inherent rotary sliding of the shaft with respect to a sealing member. The sealing at the bottom opening, on the other hand, must be achieved in association with fitting operation of the battery covering which is required to be repeatedly performed by the user upon exchanges of the battery, and the operation should not be complicated but rather easier to simultaneously achieve reliable fitting and sealing of the covering. For this purpose, it has been suggested to perform the fitting and sealing operations of the battery covering with respect to the housing bottom opening simultaneously in the same direction but, in this case, the respective operations mutually cause a reverse directional force to be effective so that only the fitting will be tight but the sealing will be insufficient. There has been suggested another type in which the fitting and sealing operations are performed respectively in a different step but, in this occasion, the operations have to be rather complicated and hard to manage for the users. In order to render the sealing of the bottom opening, further, it has been attempted to apply a larger possible force to a resilient sealing member through a pressing member, but such force is apt to become partly uneven over the entire peripheral length of the sealing member or even unduly excessive to render the sealing means easily damaged.

Referring to the sealing at the motor mounting which is comparatively easily obtainable, further, the washable cleaning of the cut-hair reservoir has been made performable only when the blade assembly is dismounted from the shaver head, while such dismounting may be made regardless to the sealing.

For the sealing called for at the switch block where a controlling handle, push-button or the like is movably mounted to a side wall of the shaver housing, the watertight sealing means is adapted generally to a transmission therethrough of movements of the handle or the like to the switch and, in this connection, the sealing for the switch has been involved in certain troubles in respect of the durability.

The present invention has been suggested in view of these defects involved in conventional electric shavers of the kind referred to.

A primary object of the present invention is, therefore, to provide an electric shaver of battery-powered and washable type which is high in the watertight sealing reliability and durability and is yet easy to manage.

Another object of the present invention is to provide a shaver of the kind referred to which allows the battery covering to be easily mounted to the housing bottom opening while properly achieving the watertight sealing.

Another related object to the present invention is to provide the electric shaver having a battery covering which allows its fitting and watertight sealing to be completed mutually in different directions without weakening each other.

Still further related object of the present invention is to provide the electric shaver wherein the battery covering achieves a uniform sealing pressure over the entire abutting peripheral length between the housing bottom opening and the covering without exerting any excessive force.

Yet further related object of the present invention is to provide the electric shaver of which the battery covering can be easily fitted to the housing bottom opening while sequentially allowing the watertight sealing to be well achieved.

Still another object of the present invention is to provide a shaver of the kind referred to which allows the cut-hair reservoir to be easily washable for cleaning without dismounting the shaving blade assembly.

Still further object of the present invention is to provide a shaver of the kind referred to wherein the watertight sealing for rotary shaft of the motor is reliable and durable without impairing smooth rotation of the shaft.

Yet another object of the present invention is to provide a shaver of the kind referred to having a switch the watertight sealing of which is high in the reliability and durability.

Other objects and advantages of the present invention shall be made evident as following explanations of the invention advances as detailed with reference to certain preferred embodiments shown in accompanying drawings, in which:

FIG. 7 is a perspective view of the battery covering employed in the shaver of FIG. 1, with all parts disassembled;

FIGS. 8 and 9 are perspective views showing the other side respectively of a dial and push-up cam employed in the battery covering shown in FIG. 7;

FIG. 16 is a perspective view as disassembled of the switch block employed in the shaver of FIG. 1;

FIG. 17 is a fragmentary vertically sectioned view showing a coupling state of a base frame in the switch block of FIG. 16 to the shaver housing;

Figure 1:
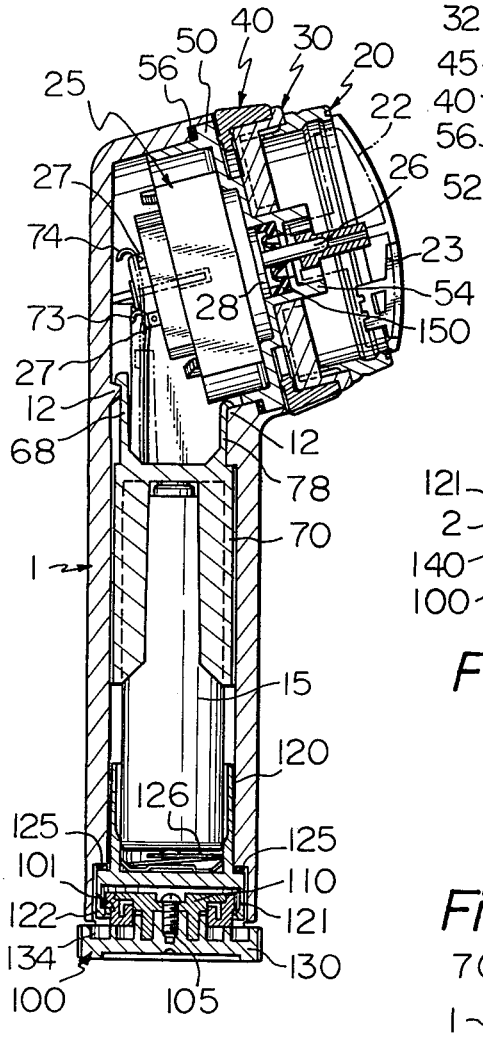
FIG. 1 is a vertically sectioned side view of an electric shaver according to the present invention.
Figure 2:
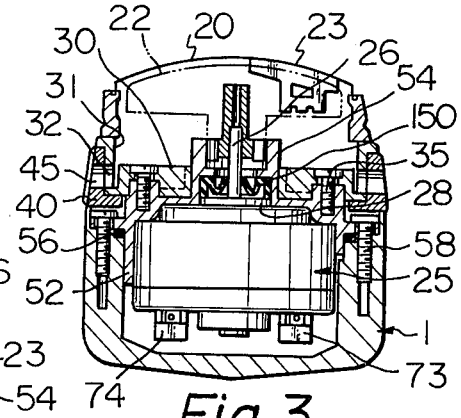
FIG. 2 is a transversely sectioned view along the rotary axis of a motor in the head part of the shaver in FIG. 1.
Figure 3:
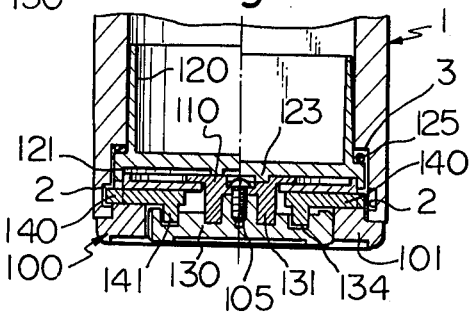
FIG. 3 is a fragmentary, vertically sectioned front view at the bottom part of the shaver shown in FIG. 1, in which left and right halves showing different states in the fitting and sealing operations of the battery covering.
Figure 18A:
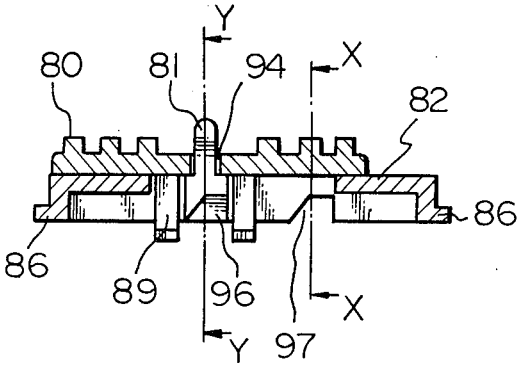
Figure 18B:
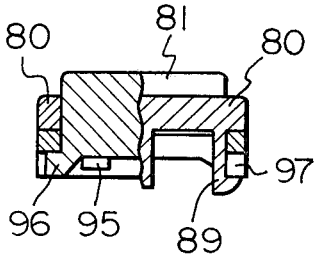
Figure 18C:
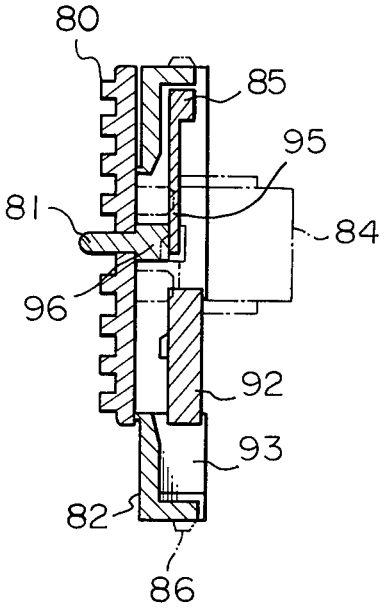
Figure 18D:
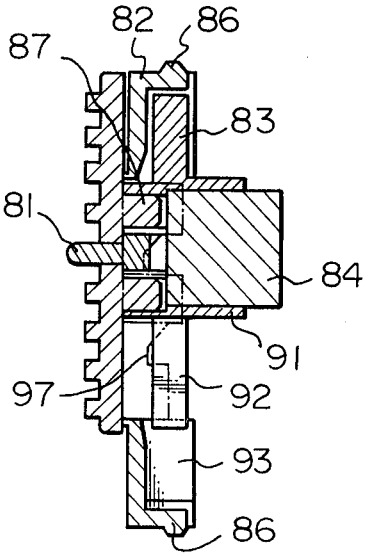

FIGS. 18A through 18D are sectioned views as assembled of the switch block of FIG. 16, wherein FIG. 18A is a vertical section of the base frame and switch handle, FIG. 18B shows in righthand half a cross section on line X—X and in lefthand half a cross section on line Y—Y in FIG. 18A, FIG. 18C is a vertical section of the block along one of push-up springs, and FIG. 18D is that along the central axis of the block;

FIGS. 19A–19D show a structure and performances of a bushing employed in the shaver of FIG. 1 for providing the sealing around the rotary shaft of the motor, wherein FIGS. 19A and 19B are respectively a perspective view and a vertically sectioned view of the bushing and FIGS. 19C and 19D are diagrams showing relations of compressive deformation of the bushing to the load torque and water leakage, respectively; and FIG. 20 is a sectioned view of the shaver head showing mounted state of the bushing of FIGS. 19A–19D.

While the present invention shall now be set forth as detailed with reference to the embodiments shown in the drawings, its intention is not to limit the invention to the particular embodiments but is rather to include all modifications, alterations and equivalent arrangements possible within the scope of appended claims.

Referring now to FIGS. 1 through 9 showing an embodiment of the present invention, a housing 1 of an electric shaver according to the present invention comprises an integral and hollow cylindrical body having a substantially rectangular cross section and opened at both head and bottom ends. A circular aperture 5 of the head end is angled in the present instance with its axis of a cylindrical part continuous to the housing body, and a shaving blade assembly 20 comprising an outer blade 21 and inner blade block 22 carrying inner blades 23 is mounted to the head end, within the cylindrical part of which an electric motor 25 secured in a motor mounting cylindrical member 50 is housed and fixed by placing a flange 55 of the member 50 on a step 6 made inside the aperture 5 with a resilient sealing ring 56 interposed between them and fastening the flange 55 to the step 6 by means of screws 58 screwed through radial notches 57 of the flange 55 into holes 7 in the step 6 and a shallow cup-shaped blade mounting base 30 is secured coaxially to the outer surface of the member 50 with screws 35 fastened through holes 34 of the base 30 into holes 63 of the member 50. The blade assembly 20 is mounted to the base 30 by screwing threaded periphery of the assembly to the inner peripheral screw threads 37 of the base 30 so that an axial hole of the inner blade block will be coupled to a rotary shaft 26 of the motor which is projected out of the motor mounting member 50 and blade mounting base 30 through an axial cylinder 54 of the member 50 which in turn is passed through an axial hole 33 of the base 30, while an annular gap between the shaft 26 and the cylinder 54 is sealed watertightly by a flexible bushing 150 of a double-lip structure as will be later detailed.

Figure 15A:
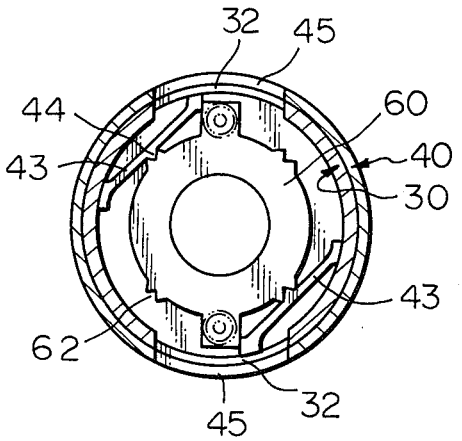
FIGS. 15A and 15B are cross sectional views of a shutter ring at the head part of the shaver in FIG. 1 showing respectively opened and closed states of washing apertures in the head part.
Figure 15B:
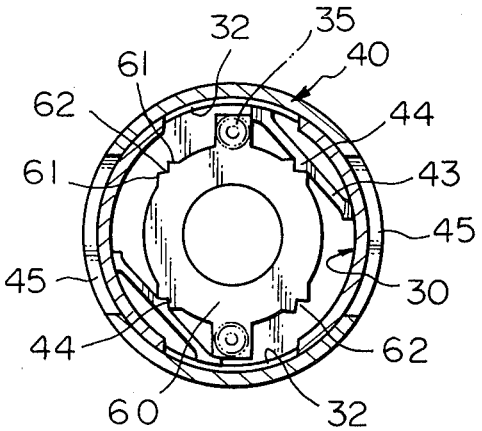

The blade mounting base 30 defines therein a cut-hair reservoir which is to be communicated with the exterior through a pair of diametrally opposing apertures 32 made in peripheral wall 31, around which there is provided a shutter ring 40 having also a pair of diametrally opposing washing apertures 45. The ring 40 is fitted slidably along the peripheral wall 31 of the base 30, inserting an inner flange 42 and a pair of diametrally and parallelly opposing arms 43 respectively made across two points on the inner flange 42 of the ring 40 into a gap between the base 30 and the member 50. As shown in FIGS. 15A and 15B, the respective arms 43 have a triangular inward projection 44 at the center and these projections 44 are respectively engageable in each of four notches 62 made at regular intervals in the peripheral wall of a circular height 60 on the motor mounting member 50 so that the ring 40 will be rotatable around the base 30 with each of the projections 44 of the arms 43 slid along the periphery of the height 60 between two engaging positions in two adjacent notches 62, at which positions the arms 43 abut radial projections of the height 60 respectively acting as a stopper for preventing further rotation of the ring 40. At one of the two engaging positions of the respective projections 44, the shutter ring 40 allows the apertures 32 of the base 30 to be communicated with the exterior through the washing apertures 45 but, at the other position, the ring 40 closes the apertures 32. Gripping notches 8 are provided on both sides of the cylindrical part of the shaver band at the parts continuous to the housing body for allowing the user to grip the shaver firmly reliably during the use of the shaver with the apertures 32 closed and the cleaning or washing of the cut-hair reservoir with the apertures 32 opened.

Referring here to the bushing 150 with reference to FIGS. 19A–19D and 20, this bushing is formed substantially in an M-shaped in section with a resilient material, wherein an axial hole 151 for passing therethrough the rotary shaft 26 of the motor 25 is defined by a thickened peripheral wall 152 of a short cylindrical shape, a thined first lip 153 extending downward and diagonally inward from the inner upper edge of the peripheral wall 152 and an also thined second lip 154 extending diagonally upward substantially from the downward edge of the first lip 152. The bushing 150 is fitted in a receptive space within the cylinder 54 of the motor mounting member 50 and between an inward flange 57 of the cylinder 54 and a shaft bearing 28 slightly extending into the space, which is so dimensioned that the bushing 150 will receive a certain extent of axial and radial compressions in the cylindrical peripheral wall 152 and resultant compressive deformation of the wall will be transmitted to the second lip 154 so as to intimately resiliently hold the shaft 26 with the lip 154 under a proper pressure for allowing the shaft 26 to freely rotate within the lip 154. To ensure that the pressure will be proper even when the dimensions of the receptive space is fluctuated or is partly uneven and when an excentricity occurs between the respective axes of the shaft and bushing, the cylindrical wall 152 is provided at both axial end surfaces and outer periphery respectively with annular projections 155 and 156 and peripheral projection 157 so that these projections will be compressively deformed first to initially absorb any uneven or excessive pressure and thereby any excessive load on the rotary shaft due to increased holding friction of the bushing 150 is prevented. In FIGS. 19C and 19D showing respectively incremental load torque changes on the rotary shaft due to incremental compressive deformation rate of the bushing and varying sealing effects under the eccentricity rate of 0.1 and 0.15 with increasing compressive deformation rate and water temperature in the case when the bushing of FIGS. 19A and 19B is employed, it is seen that the bushing of the structure as shown maintains the minimum load torque with the deformation rate of 0.1 and achieves the most effective sealing with the same deformation rate in the case of the eccentricity rate of 0.1 and in the range of normal water temperature and above the same.

Figure 4:
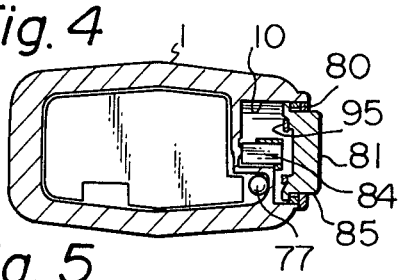
FIG. 4 is a cross sectioned view at a switch block of the shaver shown in FIG. 1.

Now, in a side wall of the housing 1 at a position adjacent the notches 8, a recess 10 for mounting therein a switch block 85 which comprises in the present instance a handle 80, lock plate 81, base frame 82, slide member 83 and permanent magnet 84 for controlling ON and OFF operations of a reed switch housed inside the housing 1 as will be detailed later. The recess 10 comprises a shallow expanded portion, centrally deep retracted portion and a pair of opposing notches 11 made in respective longitudinal side walls of the expanded portion, the base frame 82 is fitted in the expanded portion with projected hooks 86 at both longitudinal ends of the frame engaged in the respective notches 11, and the handle 80 and slide member 83 are slidably fitted to the frame 82 as coupled to each other through a longitudinal aperture 90 of the frame on both sides thereof, so as to dispose the handle 80 outside and the slide member 83 inside the frame and the magnet 84 carried in a box 91 of the member 83 within the deep retracted portion. For this purpose, as shown in FIGS. 16 to 18, inward projected bosses 87 of the handle 80 are urged into fitting holes 88 of the slide member 83 while both side hooks of the handle 80 are slidably engaged to both side inner edges of the frame 82. To give to the handle 80 and slide member 83 a clicking stop at each of ON and OFF positions, the frame 82 has a tapered projection 93 on each of opposing inner side walls and a pair of rounded tips of resilient arms 92 extended in sliding direction from the slide member 83 are resiliently contacted with the side walls of the frame to slide over these projections 93 to come into either of the ON and OFF positions. For releasably locking the handle 80 to the OFF position, the lock plate 80 is disposed through a transverse slit 94 in the handle 80 as outwardly biased by a pair of resilient plates 95 of the slide member 83 so that both end projections 96 of the lock plate 81 will engage in recesses 97 made in the frame 82 at positions corresponding to the ON and OFF positions. As these mutually engageable projections 96 and recesses 97 are tapered only in the direction toward the OFF position of the handle 80, the sliding of the handle 80 toward the ON position cannot be made unless the lock plate 81 is depressed to release the engagement of its projections 96 in the recesses 97 of the frame 82 against the biasing of the resilient plates 95 of the member 83. When the handle 80 is slid into the ON position, the magnet 84 is disposed closest to the reed switch 77 through a side wall of the deep retracted portion in the recess 10 of the housing, whereby the switch 77 is magnetically activated to close the power supply circuit between the motor 25 and the batteries 15, as seen in FIG. 4.

Figure 5:
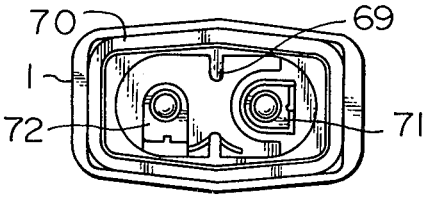
FIG. 5 is a bottom view of the shaver in FIG. 1 with the battery covering and batteries removed.
Figure 6:
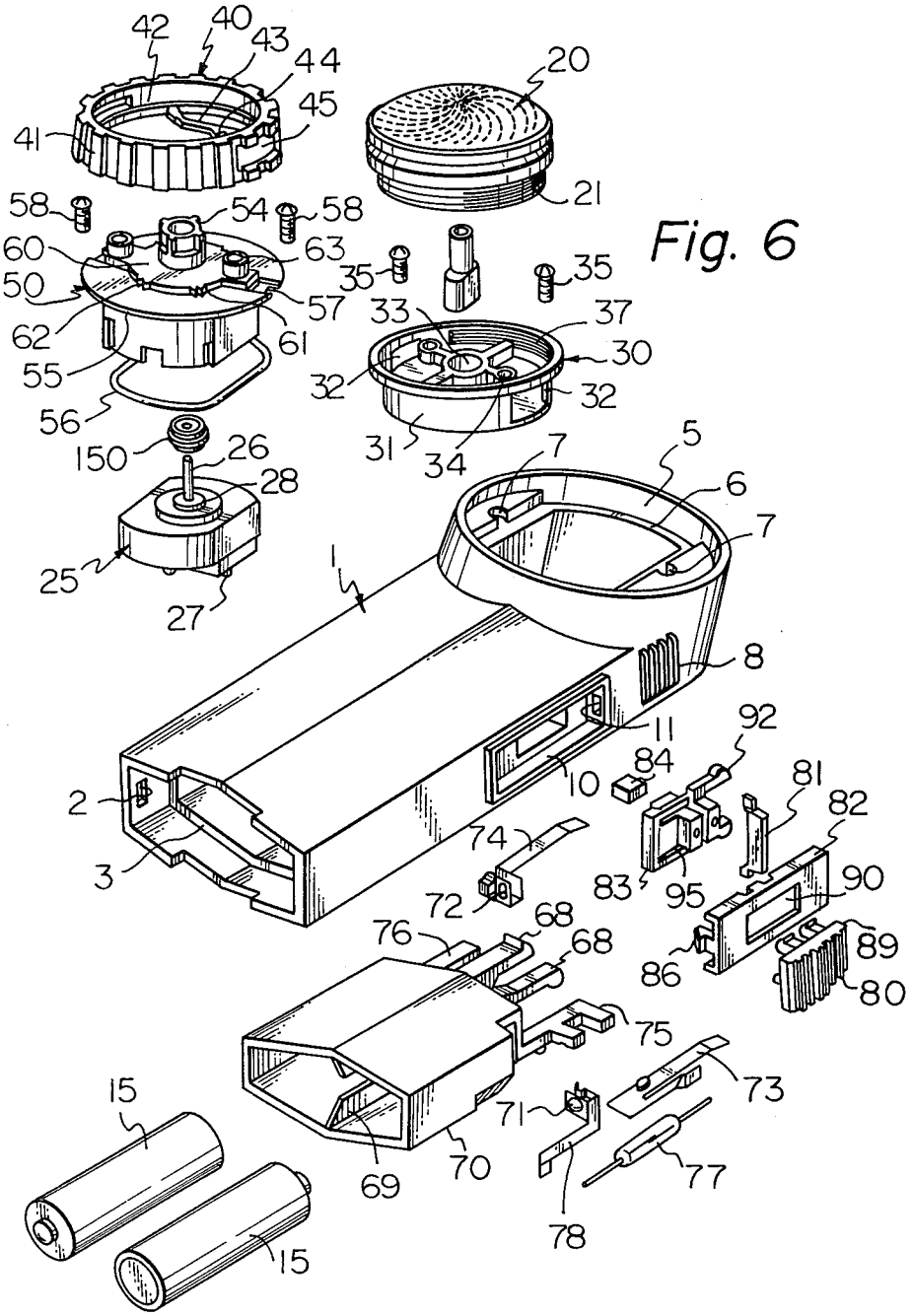
FIG. 6 is a perspective view of the shaver shown in FIG. 1 with all parts disassembled except the battery covering.

For housing the batteries 15 in the housing body and simultaneously forming the circuit, a battery case 70 opened at one axial end and having at the other closed end 69 a pair of axially extended hooks 68 is fitted within the housing body, engaging the hooks 68 to projections 12 made inside the housing 1 and bringing respective contactor springs 73 and 74 held by arms 75 and 76 also extended out of the other end of the case 70 into contact with respective motor terminals 27, while the contactor 73 is connected to one of reed contactors of the reed switch 77, and the other reed contactor of the switch 77 and contactor spring 74 are connected through the case 70 to respective electrode metal fittings 71 and 72 which are secured to the closed end 69 for contacting with positive and negative poles of the batteries 15, as seen in FIGS. 1 and 5.

Figure 10A:
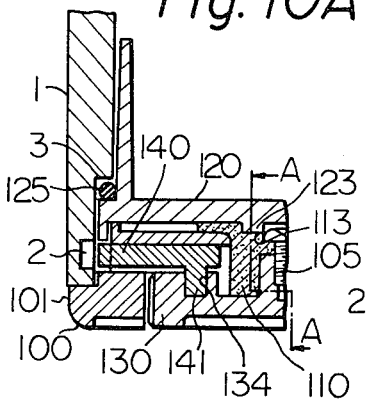
FIGS. 10A through 10C are fragmentary sectioned views showing sequential states of the respective parts of the battery covering responsive to a rotation of the dial in the shaver of FIG. 1.
Figure 11A:
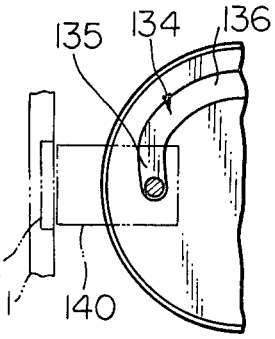
FIGS. 11A through 11C are explanatory plan views showing respective relative states of the dial to a lock member corresponding to the respective states of FIGS. 10A to 10C.
Figure 12A:
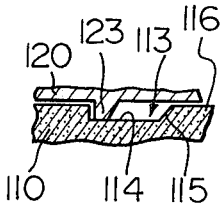
FIGS. 12A through 12C are fragmentary sectioned views as developed along line A—A in FIGS. 10A to 10B for showing respective relative positions in these drawings of the push-up cam to a battery holding inner cover of the battery covering.
Figure 10B:
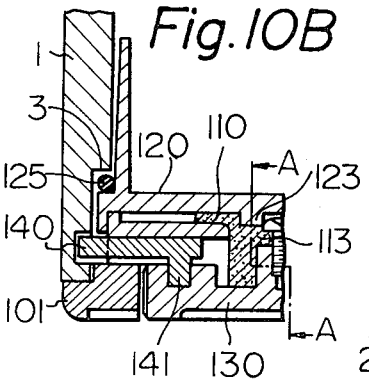
Figure 11B:
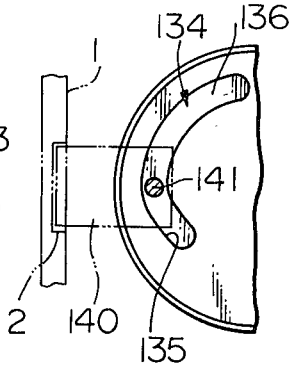
Figure 12B:
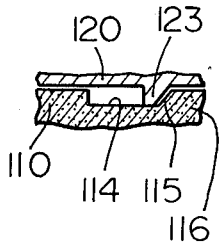
Figure 10C:
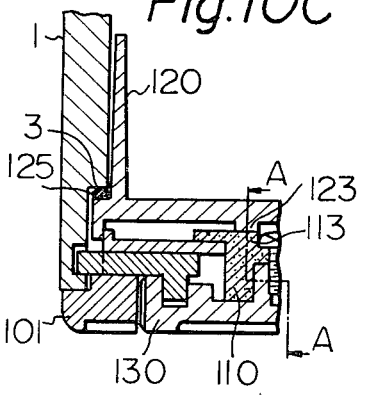
Figure 11C:
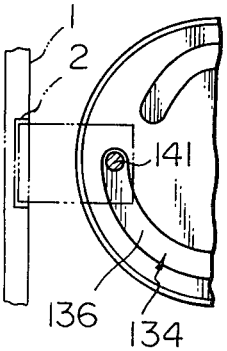
Figure 12C:
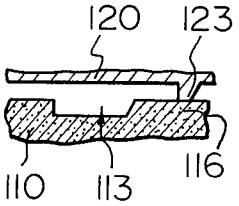

A battery covering 100 is fitted to the bottom opening of the housing to hold the batteries therein and watertightly sealing the opening. For this purpose, the covering 100 comprises means for locking the covering to the bottom opening of the housing and means for watertightly sealing between the covering and the housing. In common to the respective embodiments shown in FIGS. 1 through 12, FIG. 13 and FIGS. 14A and 14B, the covering 100 is formed generally of two parts coupled to each other mutually movably in the axial directions of the housing, one of which is an outer lid 101 substantially of a rectangular box shape fitting to the bottom opening and the other of which is an inner lid 120 substantially of a cup shape inserted into the housing for holding the batteries and electrically connecting them. The lock means comprises a pair of lock nails 140 slidably held in the outer lid 101 so as to be projected and retracted in directions transversing the axial directions of the housing by a rotation of a dial 130 axially rotatably coupled to the outer lid 101 by a screw 105 together with a push-up cam member 110 so that, when the nails 140 are projected in longitudinal directions of the lid 101, their tips ends will engage in locking recesses 2 made in the inner peripheral wall of the housing 1 adjacent the bottom opening. The inner lid 120 has an axially extended flange 121 from the periphery of the bottom of the cup shape, providing a peripheral step around the bottom, and a resilient ring seal 125 is fitted on this step. For the movable coupling, the flange 121 of the inner lid 120 is fitted to the outer lid 101 over the push-up cam 110 of the latter, engaging inward projections 122 of the flange 121 to sideward notches 107 of the outer lid 101 leaving a certain axial clearance between them while opposing endwise projections 123 on the bottom face within the flange 121 of the inner lid 120 against cam portion 113 of the cam 110. For the movable coupling of the nails 140 to the dial 130, the nails 140 respectively have a vertical pin 141 at their inner end and the pin 141 is engaged in each of a pair of substantially arcuate guide grooves 134 made in the dial 130. The respective grooves 134 comprise a first guide part 135 gradually approaching the center of the dial and a second guide part 136 continuous to the first part and running substantially along the circular periphery of the dial 130, so that as the dial 130 is rotated with the screw 105 as the center the pins 141 of the nails 140 will move along the respective guide grooves 134 and the nails 140 will be retracted while the pins 141 are in the first guide parts 135 and will be kept projected while the pins 141 are in the second parts 136, as seen in FIGS. 10 and 11. During the rotations of the dial 130, the inner lid 120 is also moved in the axial directions toward and away from the outer lid 110 in such that, when the pins 141 are in the first guide parts 135 of the grooves 134 to retract the nails 140 as in FIGS. 10A and 11A, the endwise projections 123 of the inner lid 120 are received within recesses 114 of the cam 110 as in FIG. 12A to allow the inner lid 120 to be in the closest position to the outer lid 101 and, when the pins 141 are at the junction point of the first and second guide parts 135 and 136 to project the nails 140 as in FIGS. 10B and 11B, the inner lid's projections 123 are engaged at their tapered side faces to also tapered side face 115 of cam projections 116 in the cam 110 as in FIG. 12B, whereas, when the dial is further rotated to cause the pins 141 slid along the second guide parts 136 over to terminating ends of the latter as in FIGS. 10C and 11C, the projections 123 are caused to ride onto the cam projections 116 over the tapered faces 115 as in FIG. 12C to push the inner lid 120 axially away from the outer lid 101. In this state of FIG. 12C, the ring seal 125 carried on the inner lid 120 is compressively urged by the step around the bottom part of the lid 120 thus moved away from the outer lid 101 with respect to the nails 140 locked in the recesses 2 as a fulcrum, against an inner peripheral step 3 of the housing 1 at a position inward away from the recesses 2, whereby the bottom opening of the housing is watertightly sealed, as seen in FIG. 10C.

On the inner bottom of the cup-shaped inner lid 120, there is provided a resilient connecting metal 126 having two electrodes for electrically connecting between the other positive and negative poles of the batteries 15 so that, in the fitted state of the battery covering 100 to the bottom opening of the housing 1 also as in FIG. 1, the batteries are resiliently urged against the electrode metal fittings 71 and 72 to form the power supplying circuit to the motor including the reed switch 77.

In the above described arrangement for the movable coupling between the outer and inner lids 101 and 120, the movable amount of the inner lid 120 is so defined by the clearance between the projections 122 of the lid 120 and the notches 107 of the lid 101 that no excessive compression force will be imparted to the ring seal 125 even when any dimensional error is involved in the opposing distance between the housing's step 3 and the step of the inner lid 120. Further, the endwise projections 123 of the inner lid 120 for engaging the cam 110 are arranged in the longitudinal directions of the inner lid 120, whereby the push-up stress incurred to the lid by the cam can be prevented from being concentrated to a single point in the longitudinal directions of the lid so as to avoid any uneven band of the lid but to achieve a uniform sealing effect over the entire circumferential length of the ring seal 125.

Figure 13:
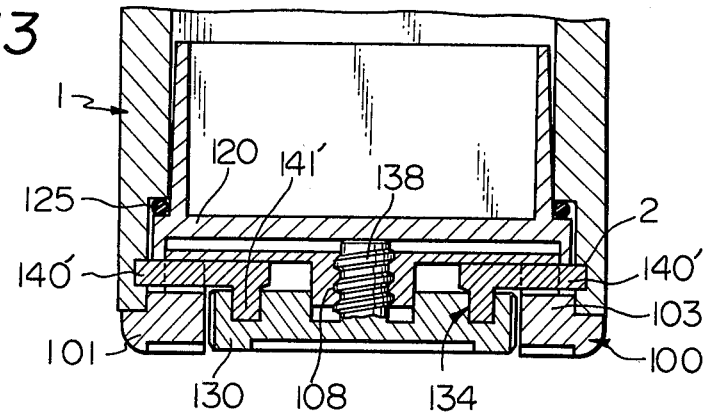
FIG. 13 is a fragmentary vertically sectioned front view at the shaver housing bottom showing another embodiment of the battery covering according to the present invention.

In the case of another embodiment shown in FIG. 13, the structure of the battery covering 100 is different from the foregoing one only in that the dial 130 is rotatably coupled to the outer lid 101 by means of an integral axial screw 138 which is screwed into a threaded hole 108 made in the center of the inner bottom wall of the outer lid 101 so as to project out of the bottom wall to abut against the bottom of the inner lid 120, omitting the cam 110 and projections 123. In the initial stage of rotations of the dial 130, the nails 140' are projected out of the lid 101 to engage at the tip ends into the recesses 2 of the housing 1 and, in the later stage, the screw 138 pushes up the inner lid 120 to axially move the lid 120 so as to achieve the sealing.

Figure 14A:
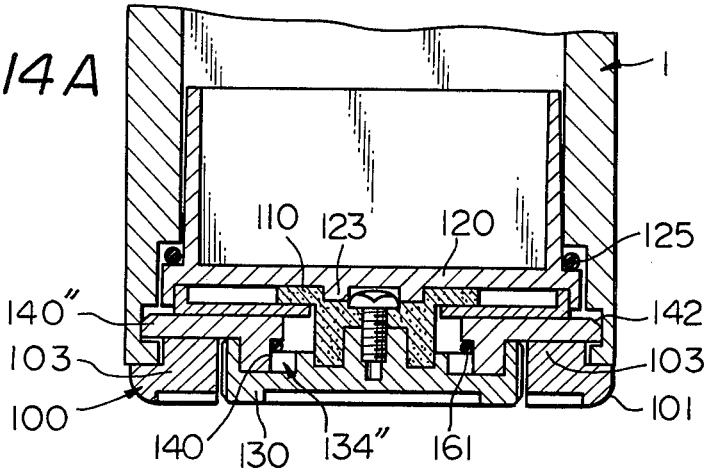
FIGS. 14A and 14B are respectively a fragmentary vertically sectioned front view in a further embodiment of the battery covering according to the present invention and its explanatory plan view showing a relative arrangement of the dial to the lock member.
Figure 14B:
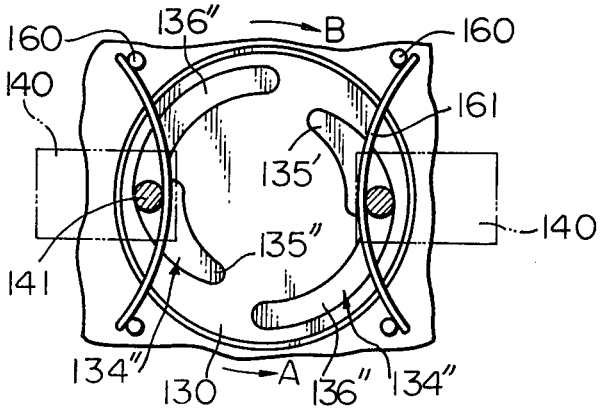

In the further embodiment of FIGS. 14A and 14B, the structures of the outer and inner lids 101 and 120 for the sealing means are the same as in the first described embodiment but, for the locking means, the locking nails 140'' are tapered at the respective tip ends 142 on the side of abutting inner peripheral edge of the bottom opening of the housing and are respectively resiliently biased in outward projected directions by means of a spring 161 arcuately locked at both ends to bosses 160 or the like of the outer lid 101, and the arcuate guide grooves 134'' in the dial 130 are recessed in radial inward direction as seen in FIG. 14B for allowing the nails to be retracted against the outward biasing specifically when the pins 140 of the nails are at the junction points of the first and second guide parts 135'' and 136'' at which points the nails are normally retained due to varying curvature of outer peripheral walls of the grooves and the biasing, so that the nails will be forced to be retracted when the tapered tip ends 142 are pressed against the edge of the housing bottom opening but will be projected into the recesses 2 thereafter. To keep the nails in the locked position in the recesses 2, the dial 130 is rotated in a direction A to dispose the pins in the second guide parts 136'' but, the covering 100 is to be dismounted, the dial 130 is rotated in the reverse direction B to guide the pins 141 into the first guide parts 135'' and retract the nails.

The movable coupling of the inner and outer lids for achieving the sealing of the battery covering may be made in some other arrangement than the above. For example, it will be possible to cause the inner lid to be pulled toward the outer lid by the rotation of the dial or even the entire outer lid so that a ring seal disposed between the bottom end edge of the housing and an opposing step of the outer lid will be compressed by such approaching movement of the inner lid toward the outer lid.

As has been disclosed, the shaver according to the present invention achieves the reliable and still simple watertight sealings at the shaving head part specifically at the projecting rotary shaft by the bushing 150 having any excessive compression force absorbing projections 155 to 157, while the cut-hair reservoir is provided with the cleaning apertures 32 closable by the shutter ring 40, at the switch block where the switch 77 is remote controlled through the side wall of the housing to remove any sealing problem, and at the bottom opening of the housing by the battery covering 100 which achieves both the sealing and mounting of the covering to the housing sequentially by the rotation of the dial 130 which is converted into movements of the lock means transversing directional to the axis of the housing and also into axial directional movements of the sealing means without weakening each other, so that the watertight sealing specifically at the bottom opening which must be made repeatedly by the user upon exchanges of the batteries can be easily and reliably achieved so as to render the shaver to be easily reliably washable specifically with respect to the cut-hair reservoir while dipping the shaving blade assembly into water with the cleaning apertures opened and safely operating the switch to be ON to rotate the inner blades in water, whereby water can be led into the reservoir and discharged with stored cut-hair out of the apertures.

What is claimed is:

1. An electric shaver wherein a motor is watertightly housed in an opening at one end of a housing, a shaving blade assembly is mounted to said one end with inner blades operably coupled to a rotary shaft of said motor projected out of the one end through a watertight sealing means, power source batteries are housed within said housing, a switch is provided in the housing so as to open and close a circuit between the motor and said batteries by means of a handle watertightly provided as exposed on the outer periphery of the housing, and a battery covering mounted to the other end opening of the housing for holding the batteries therein includes a watertight sealing means, said housing having in the inner peripheral wall along said the other end opening means for holding said battery covering to the housing, and said battery covering being provided with a lock means moved in directions transversing the axial line of the other end opening responsive to mounting operation of the covering to the opening so as to be locked in said holding means and with a seal means moved in said axial directions responsive to said mounting operation for achieving a watertight abutment between the other end opening of the housing and the battery covering over the entire periphery of them.

2. A shaver according to claim 1 wherein said battery covering comprises outer and inner lids coupled relatively movably to each other in said axial directions, said lock means comprises a slide member held in said outer lid, said seal means comprises a first engaging surface provided at least on one of said outer and inner lids to expand in said directions transversing the axial directions, a resilient sealing member placed on said first engaging surface and a second engaging surface which comprises one of sliding surfaces of said slide member, said holding means of said housing comprises two engaging surfaces respectively engageable to each of said first and second engaging surfaces in different directions along the axial directions, and said mounting operation of the battery covering achieves said abutment between the first and second engaging surfaces of the covering and said two engaging surfaces of the housing so as to compress said sealing member.

3. A shaver according to claim 1 wherein said mounting operation of said covering acts on said lock means in an earlier stage of a sequential stroke to perform said locking of the means and on said seal means in a later state of said stroke to achieve said abutment.

4. A shaver according to claim 2 wherein said outer and inner lids of said battery covering are coupled so as to be mutually separated in said axial directions by said mounting operation, said first engaging surface of said seal means comprises a peripheral edge of the inner lid facing inward the housing, and said two engaging surfaces of said housing comprises a first step provided in the inner periphery of the housing to face said the other end opening of the housing at a position remote therefrom and a second step provided in the inner periphery to face inward the housing at a position close to the opening, whereby said first and second engaging surfaces of the seal means are relatively separated from each other responsive to the mounting operation and expand through said sealing member interposed between said first and second steps of the housing to abut the steps.

5. A shaver according to claim 4 wherein said outer lid of said battery covering is provided with a dial rotatable substantially about its central axis, said slide member is a pair of lock nails moved in said transverse directions by rotations of said dial to be projected and retracted in diametrally opposing directions of the dial, and said outer lid is further provided with means for converting said rotations of the dial into linear movements in directions of said separation along said axial directions for transmitting the same to said inner lid.

6. A shaver according to claim 5 wherein said converting means is a cam member provided on a surface of said outer lid on the side of opposing said inner lid, said cam member rotating with said dial and separating the inner lid from the outer lid through projections of the inner lid engaging the cam member.

7. A shaver according to claim 5 wherein said converting means comprises a screw threaded shaft provided on said dial and screwed in a threaded hole made substantially through the center axis of said outer lid to abut at tip end against an opposing surface of said inner lid.

8. A shaver according to claim 5 wherein said dial is provided in a surface opposing inner ends of said lock nails with a pair of guide grooves respectively including a first part which gradually approaches the center of the dial and a second part continuous to the outermost position of said first part and extending therefrom along the outer periphery of the dial, and said lock nails are respectively provided with a projecting pin engaging in each of said guide grooves, said pin being moved along said first and second parts to project and retract the lock nails responsive to said rotations of the dial.

9. A shaver according to claim 8 wherein said lock nails are normally resiliently biased in projected directions of them and provided respectively at the tip on the side of engaging peripheral edge of said the other end opening of said housing with a tapered edge, and said guide grooves respectively include a recessed wall on the inner side of said dial over the entire length of said first part from continuing position thereof to said second part for allowing said pin and lock nail to be retracted and projected by said rotation of the dial.

10. A shaver according to claim 1 wherein said handle for operating said switch is mounted slidably in a recess provided in a side wall of said housing as retracted inward and carries a permanent magnet disposed within said recess, and said switch comprises a reed switch provided at a position inside the housing and adjacent the recess on its one side of sliding directions of the handle.

11. A shaver according to claim 1 wherein said sealing means for projecting said rotary shaft of said motor comprises a resilient bushing of a double-lip structure including a thickened and peripheral cylindrical part, a first thined lip part extending diagonally inward from an inner peripheral edge of said cylindrical part and a second thined lip part extending from extended end of said first lip part diagonally inward and alternate direction with respect to the first lip part, the innermost end of said second lip part defining a hole for watertightly passing therethrough the rotary shaft.

12. A shaver according to claim 11 wherein said cylindrical part of said bushing is provided with an annular projection on respective axial end surfaces and outer peripheral surface.

13. A shaver according to claim 1 wherein said one end of said housing for mounting said shaving blade assembly includes cleaning apertures made through a peripheral wall extending along said rotary shaft of said motor and defining therein a cut-hair reservoir, and said peripheral wall is provided with a shutter ring having apertures at corresponding positions to said cleaning apertures of the wall and rotatable as slid along the wall between respective positions of aligning said apertures with the cleaning apertures and closing the cleaning apertures.

* * * * *